US007559906B2

(12) United States Patent
Bugo

(10) Patent No.: US 7,559,906 B2
(45) Date of Patent: Jul. 14, 2009

(54) APPARATUS FOR MASSAGING THE CALVES

(75) Inventor: Mario Bugo, Cattolica RN (IT)

(73) Assignee: Ciar S.p.A., Pesaro (IT)

( * ) Notice: Subject to any disclaimer, the term of this patent is extended or adjusted under 35 U.S.C. 154(b) by 196 days.

(21) Appl. No.: 11/051,084

(22) Filed: Feb. 4, 2005

(65) Prior Publication Data

US 2005/0177077 A1 Aug. 11, 2005

(30) Foreign Application Priority Data

Feb. 11, 2004 (EP) ..... 04003080

(51) Int. Cl.
*A61H 7/00* (2006.01)

(52) U.S. Cl. ..... 601/90; 601/93; 601/133; 601/134

(58) Field of Classification Search ..... 601/84, 601/90, 93, 94, 112, 118, 133, 134
See application file for complete search history.

(56) References Cited

U.S. PATENT DOCUMENTS 5,445,595 A 8/1995 Chou
6,251,089 B1 * 6/2001 Kuznets et al. ..... 601/95
6,629,940 B2 * 10/2003 Shimizu ..... 601/133
2006/0030800 A1 * 2/2006 Kassel et al. ..... 601/90

FOREIGN PATENT DOCUMENTS

EP 1 269 962 A1 1/2003
JP 2003265567 A * 9/2003

* cited by examiner

*Primary Examiner*—Danton DeMille
(74) *Attorney, Agent, or Firm*—Muramatsu & Associates

(57) ABSTRACT

An apparatus for massaging calves is able to adjust a distance between two plates, the apparatus having at least two plates that are arranged at a distance from one another and that come into contact with the calf during massage on both sides thereof, and having a drive shaft, the plates being connected to the drive shaft by coupling members in such a manner that a rotational movement of the drive shaft brings about a movement of the plates for carrying out the calf massage. A distance adjusting mechanism is also provided in order to adapt the distance between the two plates to the size of the calf to be massaged.

8 Claims, 6 Drawing Sheets

APPARATUS FOR MASSAGING THE CALVES

FIELD OF THE INVENTION

The invention relates to an apparatus for massaging the calves, having at least two plates that are arranged at a distance from one another and that come into contact with the calf during massage on both sides thereof, and having a drive shaft, the plates being connected to the drive shaft by means of coupling members in such a manner that a rotational movement of the drive shaft brings about a movement of the plates for carrying out the calf massage.

BACKGROUND OF THE INVENTION

Massage chairs which, in addition to such an apparatus for massaging the calves, generally also have an apparatus for back massage are known from practice. However, it has been found that different users have very different opinions on calf massage. For example, many users find the massage rather unpleasant, while others hardly detect a massaging effect.

U.S. Pat. No. 5,445,595 discloses a massaging machine having two massaging elements, a drive shaft connected to the massaging elements by coupling members such that a rotational movement of the shaft brings about movement of the massaging elements and further comprising means for adapting the distance between the two plates.

Furthermore, a vibrator for lower limbs is known from EP-A-1 269 962.

SUMMARY OF THE INVENTION

The object of the invention is therefore to improve the apparatus for massaging the calves to the effect that individual adjustment of the apparatus can be carried out by any user.

The apparatus according to the invention for massaging the calves basically comprises at least two plates that are arranged at a distance from one another and that come into contact with the calf during massage on both sides thereof, and a drive shaft, the plates being connected to the drive shaft by means of coupling members in such a manner that a rotational movement of the drive shaft brings about a movement of the plates for carrying out the calf massage.

Means are also provided in order to adapt the distance between the two plates to the size of the calf to be massaged, whereby at least one of the two coupling members is held displaceably on the drive shaft, while the other coupling member bears against a stationary abutment.

As a result of this measure, it is possible to adjust the apparatus in a specific manner to calves of different sizes in order to bring about a satisfactory massage effect.

According to a preferred embodiment, a spring may be provided between the two coupling members in order, on the one hand, to compensate for clearance between coupling member and abutment and, on the other hand, to ensure the displaceability of the one coupling member.

According to a preferred development, the means for adapting the distance between the plates have a rotatable operating member, especially a handwheel, which acts on an operating linkage, especially a lever arm, in order to bring about a displacement of one of the two coupling members on the drive shaft.

According to a special development, one of the two coupling members bears against a stationary abutment, while the other coupling member cooperates with a displaceable abutment, the means for adapting the distance between the plates comprising a double-armed lever arm which is connected by its one end to the displaceable abutment and by its other end to an operating member.

The apparatus for massaging the calves generally comprises four plates (two sets of pair of plates), each of which is connected to the drive shaft by means of a respective coupling member, so that the two calves can be massaged simultaneously. The massage movement is caused by the coupling members which are disposed eccentrically relative to the drive shaft and, as a result, transmit an eccentric movement onto the plates.

BRIEF DESCRIPTION OF THE DRAWINGS

Further advantages and developments of the invention are described in more detail hereinafter with reference to the description of an embodiment and the drawings.

DETAILED DESCRIPTION OF THE INVENTION

Figure 1:
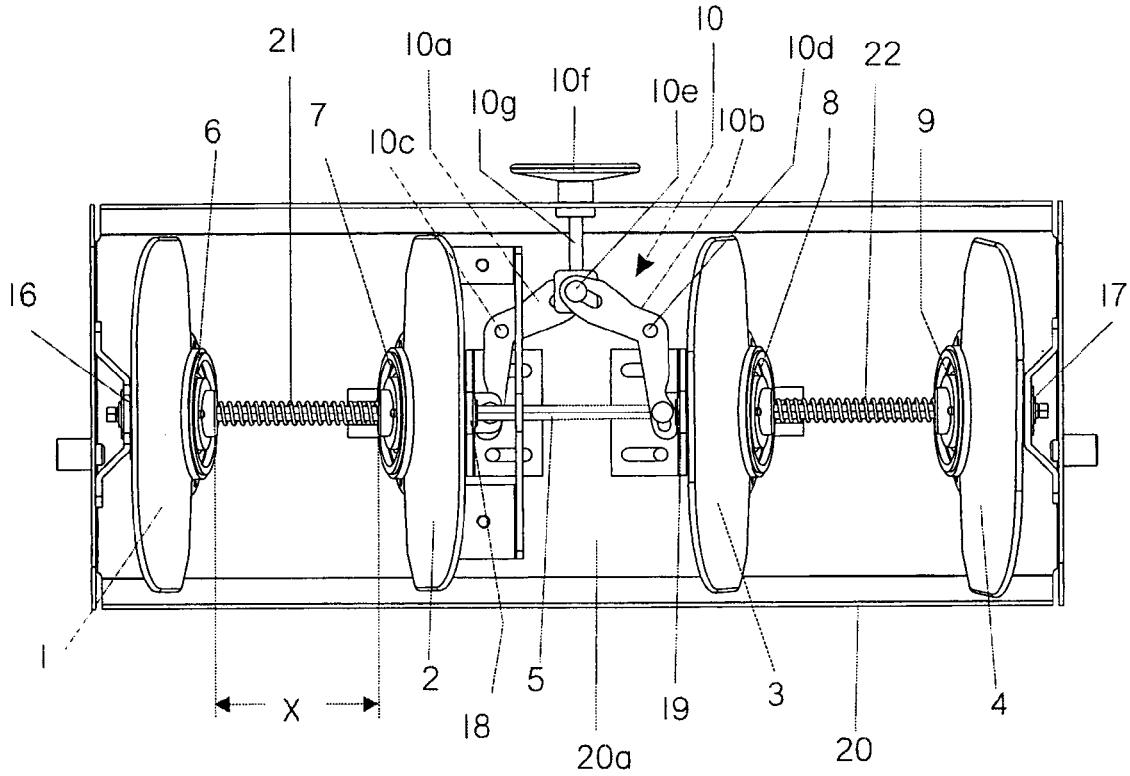
FIG. 1 is a plan view of the apparatus according to the invention for massaging the calves.
Figure 2:
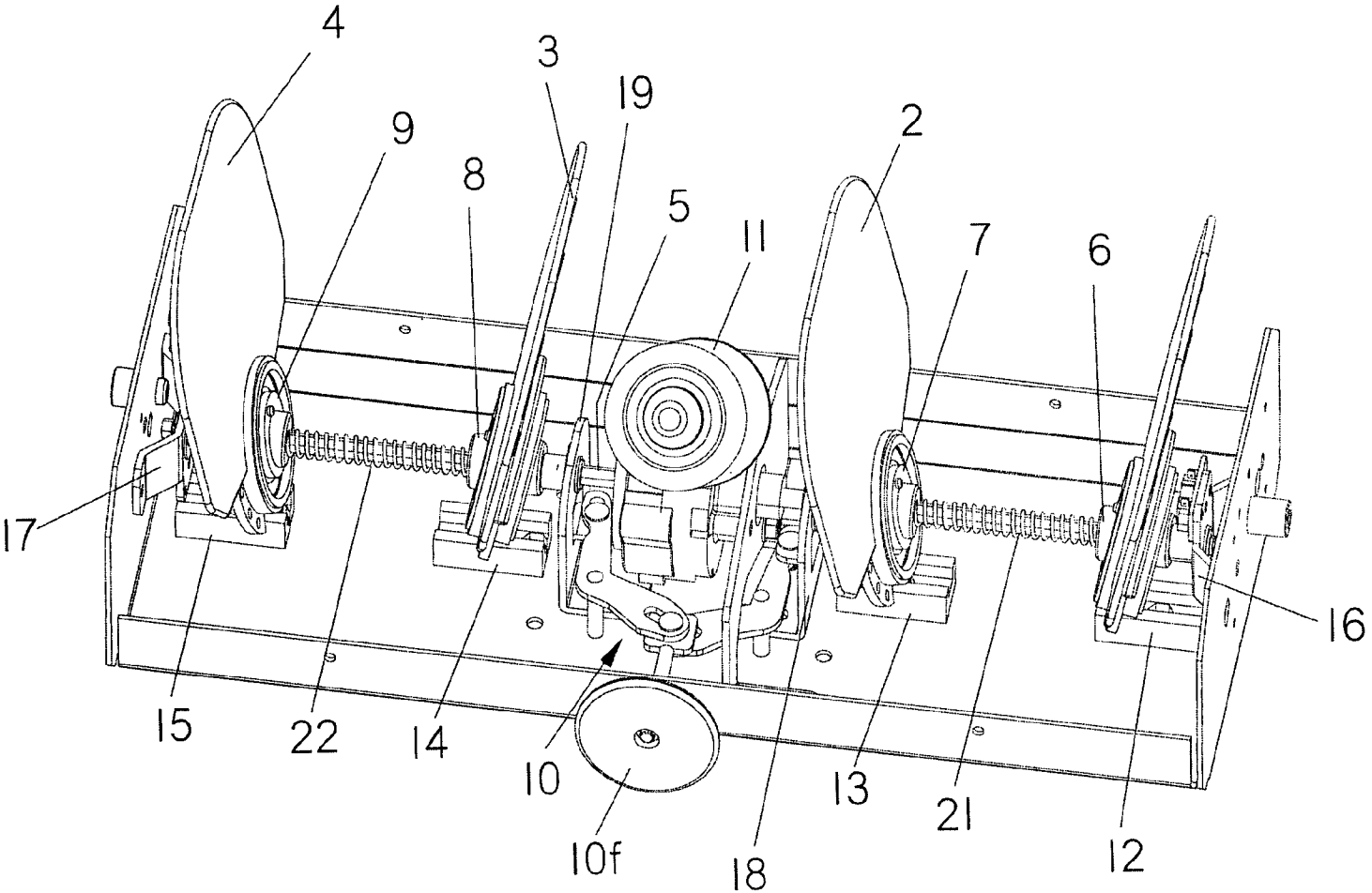
FIG. 2 is a three-dimensional representation of the apparatus according to FIG. 1.
Figure 3A:
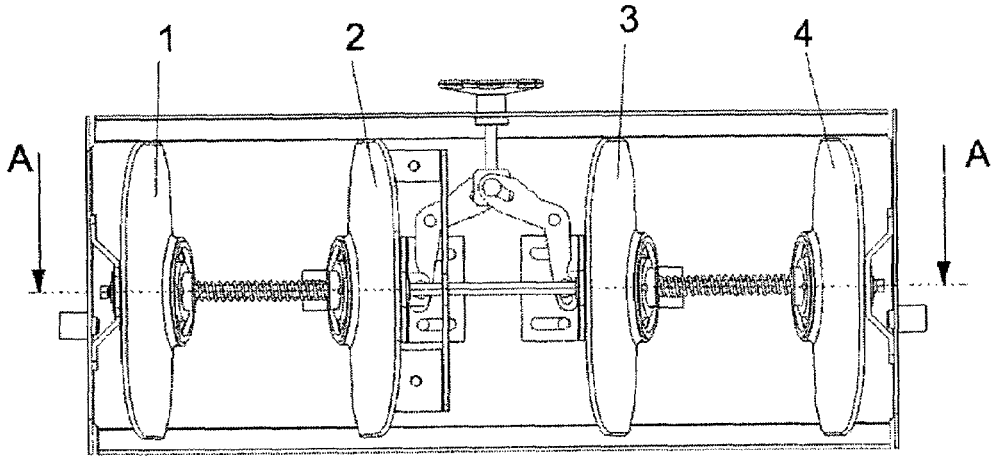
FIG. 3*a* is a plan view of the apparatus in a first massage position.
Figure 3B:
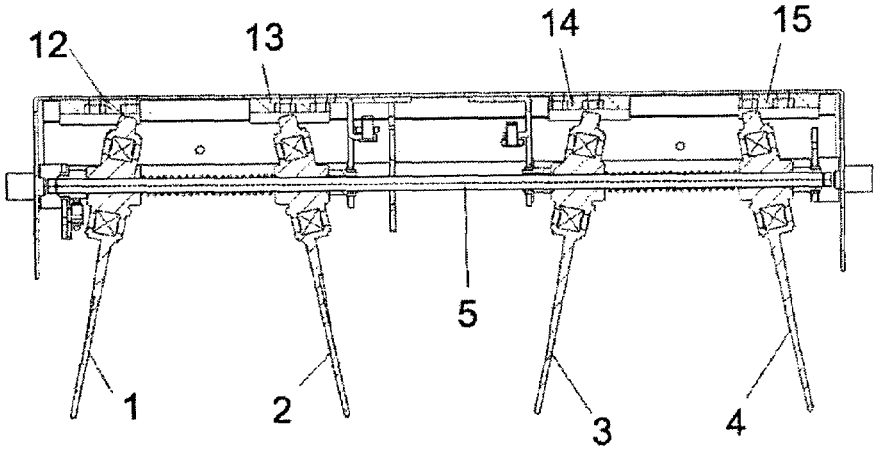
FIG. 3*b* is a cross-sectional view along the line A-A in FIG. 3*a*.
Figure 4A:
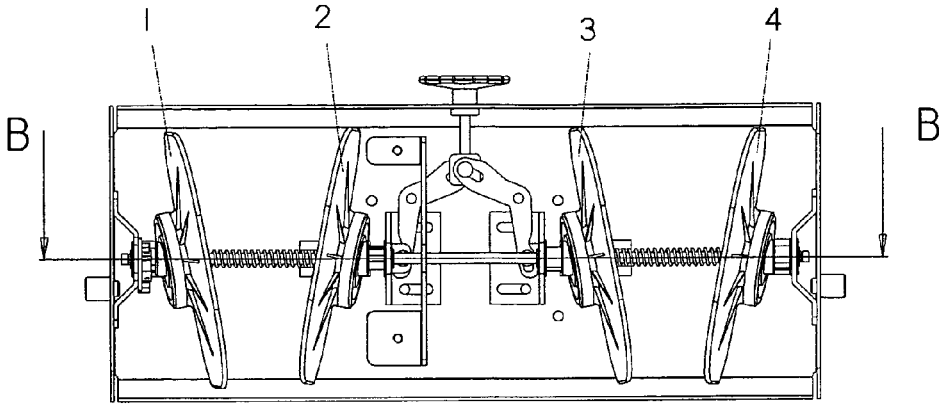
FIG. 4*a* is a plan view of the apparatus in a second massage position.
Figure 4B:
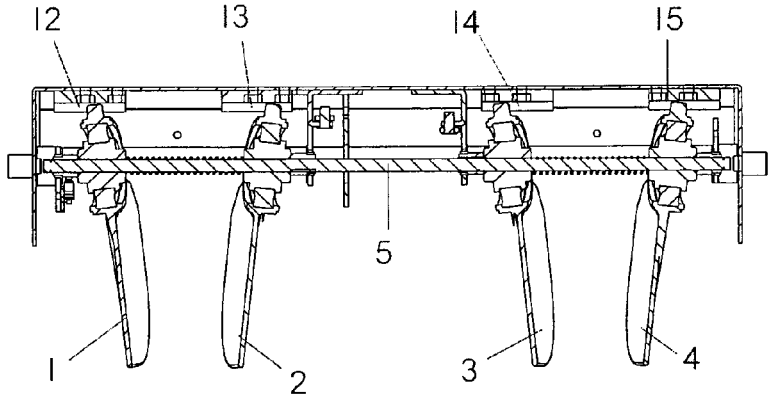
FIG. 4*b* is a cross-sectional view along the line B-B in FIG. 4*a*.
Figure 5A:
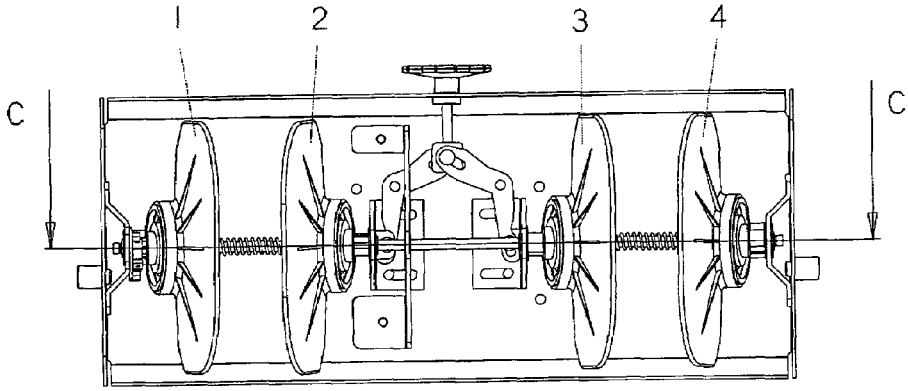
FIG. 5*a* is a plan view of the apparatus in a third massage position.
Figure 5B:
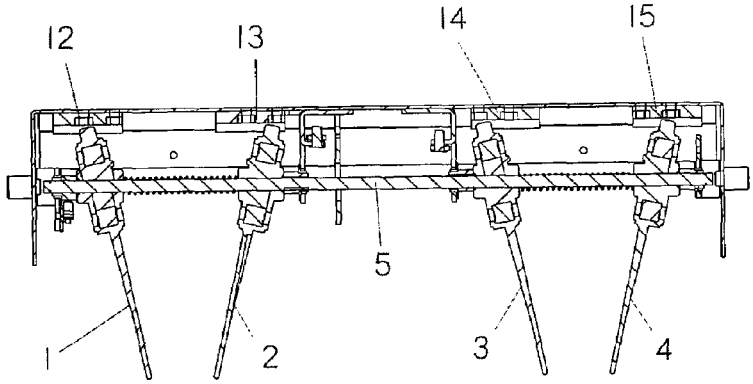
FIG. 5*b* is a cross-sectional view along the line C-C in FIG. 5*a*.

The apparatus shown in FIGS. 1 and 2 for massaging the calves basically comprises 2 sets of pair of plates 1, 2, 3 and 4 that are arranged at a distance from one another and that come into contact with the calf during massage on both sides thereof. In addition, a drive shaft 5 is provided, the plates being connected to the drive shaft 5 by means of coupling members 6, 7, 8 and 9 in such a manner that a rotational movement of the drive shaft brings about a movement of the plates 1, 2, 3 and 4 for carrying out the calf massage.

Finally, means (distance adjusting mechanism) 10 are also provided in order to alter the distance x between the two plates of each set in order to adapt it to the size of the calf to be massaged.

The whole apparatus is of course integrated in the usual form in a massage chair or the like, the entire mechanism generally being faced with upholstery and covering material. During massage, the user positions his one calf between the plates 1 and 2 (the first set of pair of plates) and his other calf between the plates 3 and 4 (the second set of pair of plates), so that it is possible to massage the two calves simultaneously.

The coupling members 6-9 each hold a respective one of the plates 1-4 and are arranged eccentrically on the drive shaft 5 so that a rotational movement of the drive shaft 5 leads to an eccentric movement of the plates 1-4. The plates are shown in three different massage positions in FIGS. 3*a*-5*b*. The movement of the plates 1-4 is repeated with each rotation of the drive shaft.

In FIG. 2, the reference sign 11 denotes a motor which drives the drive shaft 5 by means of suitable gearing.

Each coupling member 6-9 firstly holds a respective one of the plates 1-4 and is additionally supported in an associated guide rail 12-15 (see FIG. 2). The guide rails prevent the plate 1 from rotating about the drive shaft 5 and permit a sliding movement of the coupling members 6-9 during massage (see FIGS. 3*a*-5*b*).

For each set of pair of plates 1, 2 and 3, 4, a respective one of the associated coupling members, 6 and 9, bears against a stationary abutment 16 and 17, respectively. Each of the respective other coupling members 7, 8 cooperates with a displaceable abutment 18, 19, respectively. In the embodiment shown, the displaceable abutments 18, 19 are formed by angle members which are displaceably held on the base 20*a* of a housing 20 surrounding the apparatus.

The coupling members 7 and 8 are held displaceably on the drive shaft 5 so that a displacement of the displaceable abutments 18, 19 brings about a displacement of the coupling members 7, 8 and therefore of the plates 2, 3.

Between the coupling members 6, 7 and 8, 9, respective springs 21, 22 are fitted on the shaft and urge the two coupling members 6, 7 and 8, 9, respectively, against the abutments 16, 18 and 17, 19, respectively, and thereby also permit clearance-free movement.

In the embodiment shown in FIG. 1, the means 10 for adapting the distance x between the plates comprise two double-armed lever arms 10*a*, 10*b* which are pivotably supported about axes 10*c*, 10*d*. A respective end of the lever arm 10*a* is connected to a respective end of the lever arm 10*b* by means of a pin 10*e*, while the other two ends of the lever arms are in operative contact with the displaceable abutments 18 and 19, respectively. Also provided is an operating member 10*f* which is here in. the form of a handwheel and cooperates in such a manner with the two ends of the lever arms 10*a* and 10*b* connected by the pin 10*e* that operation of the operating member 10*f* brings about a rotation of the lever arms about the pins 10*c* and 10*d*, respectively. The handwheel is connected to a threaded rod 10*g* which cooperates with a threaded block which has a corresponding structure and which in turn carries the pin 10*e*. A rotation of the threaded rod therefore brings about a displacement of the threaded block along the rod and, as a result, a rotation of the lever arms. This in turn has the result that the displaceable abutments 18, 19 connected to the levers 10*a*, 10*b* are displaced correspondingly in the longitudinal direction of the drive shaft 5 and thereby alter the distance x between the plates 1, 2 and 3, 4, respectively.

The means 10 described above for adapting the distance are in a form such that operation may be effected even when massage is in progress. This is especially advantageous because the user can best tell during operation whether the massage is being performed satisfactorily.

It will be appreciated that other adjusting mechanisms are also possible within the scope of the invention. For example, in particular, an individual or common adjustment of the two pairs of plates could also be effected by means of an electrical motor.

Figure 6A:
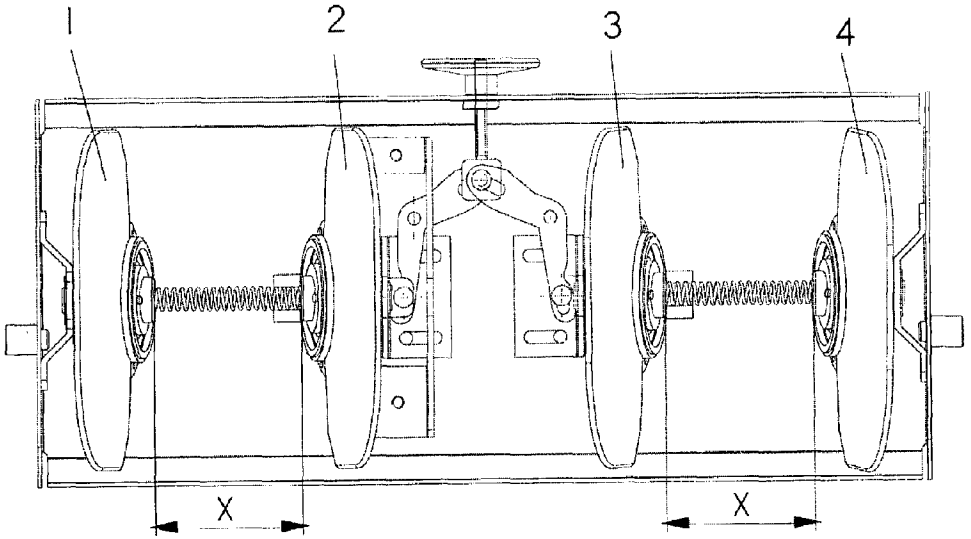
FIG. 6*a* shows the apparatus for massaging the calves having a plate distance x.
Figure 6B:
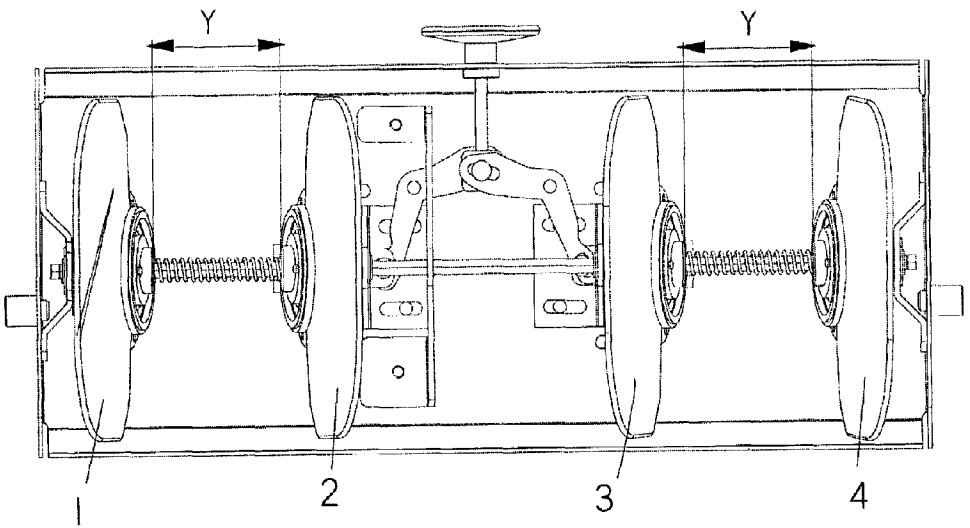
FIG. 6*b* shows the apparatus for massaging the calves having a plate distance y which is smaller than x.

FIGS. 6*a* and 6*b* show diagrammatically two different adjustments of the distance between the plates. In FIG. 6*a* the distance x between the plates 1, 2 and 3, 4 is greater than the distance y in FIG. 6*b*.

The means 10 described above for adapting the distance between the plates permit individual adjustment of the distance to the user's calves. As a result, according to the size of the calves, it is always possible to find an adjustment which leads to optimum massaging.

What is claimed is:

1. An apparatus for massaging calves, comprising:

at least two pairs of associated two plates that are arranged at a distance from one another and that come into contact with the calf during massage on both sides thereof, a drive shaft, each of the associated plates being connected to the drive shaft by coupling members in such a manner that a rotational movement of the drive shaft brings about a movement of the plates for carrying out the calf massage, wherein one of the two coupling members of each pair of associated plates is held displaceably on the drive shaft, while the other coupling member of each pair of associated plates bears against a stationary abutment, and an adjustment mechanism for adjusting a distance between the two associated plates of each pair corresponding to a size of the calf to be massaged, the adjustment mechanism comprising an operating member for a common adjustment of the two pairs of associated plates by displacing a displaceable abutment of each pair of plates.

2. An apparatus according to claim 1, wherein one of the two coupling members bears against the stationary abutment, while the other coupling member cooperates with a displaceable abutment.

3. An apparatus according to claim 2, wherein a spring is provided between the two coupling members.

4. An apparatus according to claim 1, wherein at least one of the two coupling members is held displaceably on the drive shaft and cooperates with the means for adapting the distance between the plates.

5. An apparatus according to claim 1, wherein at least one of the two coupling members is held displaceably on the drive shaft and cooperates with the means for adapting the distance between the plates, the connection of the coupling member to the drive shaft being in a form such that a displacement of the coupling member is possible during the rotation of the drive shaft.

6. An apparatus according to claim 1, wherein one of the two coupling members bears against a stationary abutment, while the other coupling member cooperates with a displaceable abutment, the means for adapting the distance between the plates comprising a double-armed lever arm which is connected by its one end to the displaceable abutment and by its other end to an operating member.

7. An apparatus according to claim 1, wherein the means for adapting the distance between the plates comprise a rotatable operating member which acts on an operating linkage in order to bring about displacement of one of the two coupling members on the drive shaft.

8. An apparatus according to claim 1, wherein the coupling members are in a form such that they bring about an eccentric movement of the plates.

* * * * *